US009738961B2

(12) United States Patent
Kuhn et al.

(10) Patent No.: US 9,738,961 B2
(45) Date of Patent: Aug. 22, 2017

(54) COPPER-NICKEL-ZINC ALLOY CONTAINING SILICON

(71) Applicant: Wieland-Werke AG, Ulm (DE)

(72) Inventors: Hans-Achim Kuhn, Illertissen (DE); Rudolf Liebsch, Voehringen (DE)

(73) Assignee: WIELAND-WERKE AG, Ulm (DE)

( * ) Notice: Subject to any disclaimer, the term of this patent is extended or adjusted under 35 U.S.C. 154(b) by 0 days.

(21) Appl. No.: 15/278,448

(22) Filed: Sep. 28, 2016

(65) Prior Publication Data

US 2017/0016097 A1 Jan. 19, 2017

Related U.S. Application Data

(62) Division of application No. 14/383,261, filed as application No. PCT/EP2013/000373 on Feb. 8, 2013, now Pat. No. 9,617,629.

(30) Foreign Application Priority Data

Mar. 7, 2012 (DE) ..... 10 2012 004 725

(51) Int. Cl.

| | |
|---|---|
| ***C22F 1/08*** | (2006.01) |
| ***C21D 7/02*** | (2006.01) |
| ***C21D 9/52*** | (2006.01) |
| ***C22C 9/04*** | (2006.01) |
| ***C21D 9/04*** | (2006.01) |
| ***B22D 11/00*** | (2006.01) |
| ***C22C 30/02*** | (2006.01) |
| ***C22C 30/06*** | (2006.01) |
| ***C22C 30/04*** | (2006.01) |
| ***C22F 1/00*** | (2006.01) |
| *B21C 37/04* | (2006.01) |
| *B21K 1/44* | (2006.01) |

(52) U.S. Cl.

CPC ..... *C22F 1/08* (2013.01); *B22D 11/001* (2013.01); *B22D 11/004* (2013.01); *B22D 11/005* (2013.01); *C21D 7/02* (2013.01); *C21D 9/04* (2013.01); *C21D 9/52* (2013.01); *C22C 9/04* (2013.01); *C22C 30/02* (2013.01); *C22C 30/04* (2013.01); *C22C 30/06* (2013.01); *C22F 1/002* (2013.01); *B21C 37/04* (2013.01); *B21K 1/44* (2013.01)

(58) Field of Classification Search

CPC ..... C22C 38/02; C22C 30/04; C22C 30/06
See application file for complete search history.

(56) References Cited

U.S. PATENT DOCUMENTS

| | | | |
|---|---|---|---|
| 3,627,593 | A | 12/1971 | Ansuini et al. |
| 4,631,171 | A | 12/1986 | McDonald et al. |
| 4,684,052 | A | 8/1987 | McDonald et al. |
| 4,954,187 | A | 9/1990 | Gaag et al. |
| 5,658,401 | A | 8/1997 | Gaag et al. |
| 2006/0065336 | A1 | 3/2006 | Gillieron et al. |
| 2009/0022620 | A1 | 1/2009 | Weber |

FOREIGN PATENT DOCUMENTS

| | | | | |
|---|---|---|---|---|
| CH | 700 999 | A2 | | 11/2010 |
| DE | 1 120 151 | B | | 12/1961 |
| DE | 1120151 | | * | 12/1961 |
| DE | 1 205 285 | | | 11/1965 |
| DE | 1 238 220 | B | | 4/1967 |
| DE | 1 558 817 | A1 | | 4/1970 |
| DE | 4 339 426 | A1 | | 5/1995 |
| DE | 10 2007 029 991 | A1 | | 1/2009 |
| DE | 10 2009 021 336 | A1 | | 11/2010 |
| EP | 0 222 004 | B1 | | 5/1987 |
| EP | 1 608 789 | B1 | | 12/2005 |
| JP | 01-116044 | A | | 5/1989 |
| JP | 01-177327 | A | | 7/1989 |
| JP | 03-068732 | A | | 3/1991 |
| JP | 07-166279 | A | | 6/1995 |
| JP | 07-216493 | A | | 8/1995 |

OTHER PUBLICATIONS

Japanese Office Action for corresponding application No. 2014-559120, dated Jul. 28, 2015, with partial English translation thereof (7 pages).
International Search Report for corresponding PCT/EP2013/00373, dated May 19, 2014, with partial English translation thereof (3 pages).
German Office Action for corresponding application No. 10 2012 004 725.8, dated Dec. 4, 2012, (6 pages).

* cited by examiner

*Primary Examiner* — Rebecca Lee
(74) *Attorney, Agent, or Firm* — Flynn, Thiel, Boutell & Tanis, P.C.

(57) ABSTRACT

The invention includes a copper-nickel-zinc alloy with the following composition in weight %: Cu 47.0 to 49.0%, Ni 8.0 to 10.0%, Mn 0.2 to 0.6%, Si 0.05 to 0.4%, Pb 1.0 to 1.5%, Fe and/or Co up to 0.8%, the rest being Zn and unavoidable impurities, wherein the total of the Fe content and double the Co content is at least 0.1 weight % and wherein mixing silicides containing nickel, iron and manganese and/or containing nickel, cobalt and manganese are stored as spherical or ellipsoidal particles in a structure consisting of an α- and β-phase. The invention further relates to a method for producing semi-finished products from a copper-nickel-zinc alloy.

6 Claims, No Drawings

COPPER-NICKEL-ZINC ALLOY CONTAINING SILICON

This is a divisional of prior U.S. application Ser. No. 14/383,261, which was the national stage of International Application No. PCT/EP2013/000373, filed Feb. 8, 2013.

The invention relates to a copper-nickel-zinc alloy and also to processes for producing semifinished products made of this alloy.

Alloys consisting of copper, nickel and zinc are referred to as nickel silver on account of their silver-like colors. Alloys which are common in industry contain between 47 and 64% by weight copper and between 10 and 25% by weight nickel. In the case of alloys which can be turned and drilled, up to 2.5% by weight lead is usually added as chip breaker, in the case of cast alloys even up to 9% by weight. The remainder is zinc. These are single-phase materials which merely form an α phase.

As additions, commercially available nickel silver alloys can moreover contain 0.5 to 0.7% by weight manganese, in order to reduce the annealing brittleness. The manganese addition also has a deoxidizing and desulfurizing action.

The nickel content firstly changes the color; above approximately 12% by weight nickel, the materials have a pure white to silver-gray appearance. Secondly, comparatively good corrosion resistance and increased strength values are also achieved. Compared to copper, however, nickel silver alloys have an increased electrical resistance and accordingly also a lower thermal conductivity.

In terms of their microstructure, nickel silver alloys correspond approximately to the α-brasses or the (α+β)-brasses, since nickel replaces copper virtually as an equivalent. Of the standardized copper-nickel-zinc wrought alloys, CuNi25Zn15, CuNi18Zn20, CuNi12Zn24, CuNi18Zn19Pb and CuNi12Zn30Pb form a homogeneous a microstructure. By contrast, the two-phase wrought alloy CuNi10Zn42Pb lies in the (α+β) field.

In addition, copper-nickel-zinc alloys having a considerably increased manganese content which goes beyond a deoxidization action are also known. By way of example, a known alloy CuNi12Zn38Mn5Pb2 has a considerably lower copper proportion and an increased zinc proportion. Alloys of this type are in turn two-phase materials, consisting of α and β phase. For better machinability, the element Pb is present as chip breaker to a considerable proportion in the manganese-containing nickel silver alloys.

Lead makes the wrought alloys easier to machine, but reduces the toughness and increases the hot cracking sensitivity during annealing. The capability of a alloys to be hot formed is greatly impaired by lead, and therefore these are usually only cold formed. By contrast, the good capability of the (α+β) alloys to be hot formed is not influenced significantly by lead.

Nickel silver alloys containing manganese have already been described in patent literature, too. By way of example, nickel silver alloys of the composition 43 to 48% Cu, 33 to 38% Zn, 10 to 15% Ni and 3.5 to 6.5% Mn are known from document EP 1 608 789 B1. Up to 4% Pb can optionally also be present. The addition of lead should again bring about better machinability. Firstly, the two-phase alloy with an (α+β) structure is subjected to hot forming, and then a temperature treatment is carried out preferably in the range of 630 to 720° C. As a result of this temperature treatment, the alloy is transformed into a pure α structure. This structure is then suitable for further cold forming steps, in which, for example, tips for writing instruments are produced. However, in this case machining, for example drilling, will only be economically expedient with a lead addition.

Copper alloys of the composition 43 to 57% Cu, 23 to 37% Zn, 7 to 13% Ni and 7 to 13% Mn, which moreover also contain 0.05 to 2% Si, are known from document EP 0 222 004 B1. The alloy is intended to be used in the form of wire material, strips, powder or paste for brazing. A composition which is preferred for wire material is 55% Cu, 8% Ni, 12% Mn, 0.15% Si, remainder Zn. This brazing material is preferably used to join materials of a carbidic composition to steel. For this purpose, the brazing filler metal is inserted between the parts to be joined, and joined to the joining partner at a temperature above its melting temperature. Copper alloys of the composition 15 to 50% Cu, 10.2 to 18% Ni and 0.1 to 15% Mn, which moreover also contain 0.1 to 1% Si, remainder Zn, are also known from document CH 298973.

Further copper-nickel-zinc alloys for semifinished products and objects which are subjected to high levels of loading and are exposed to a high degree of wear and have a high coefficient of friction, in particular for synchronizer rings, are known from document DE 43 39 426 C2. These alloys consist of 41 to 65% Cu, more than 8 to 25% Ni, 2.5 to 5% Si, 1 to 3% Al, 0 to 3% Fe, 0 to 2% Mn, 0 to 2% Pb, remainder zinc and unavoidable impurities, the Ni:Si ratio being 3:1 to 5:1. The microstructure consists at least to an extent of 75% of β proportions, the remainder being a proportions. In addition to these phases, nickel silicides are formed as predominantly round intermetallic phases. The very high contents of nickel and silicon are essential to the properties of these alloys, and have the effect that nickel silicides are present in the matrix in a content of approximately 35% by volume. Additions of iron, manganese and lead have a negative effect on the wear resistance of these alloys.

Document DE 1 120 151 discloses nickel silver alloys having a high strength and with beneficial properties in terms of the ability to be cast and the ability to be hot formed. These alloys consist of 0.01 to 5% Si, more than 10 to 30% Ni, 45 to 70% Cu, 0.3 to 5% Mn, remainder at least 10% zinc. Small additions of Si serve for the deoxidization of the alloy and to improve the casting properties. The aim of the manganese addition is to increase the toughness and therefore the cold workability of the alloy, and it also serves to reduce the nickel content. Optionally, manganese can be replaced entirely by aluminum, and nickel can be replaced partially by cobalt. The addition of iron to the alloy should be avoided, since iron reduces the corrosion resistance of the alloy. With a manganese content of 1%, strength values of approximately 400 MPa are achieved. To improve the mechanical properties, a heat treatment is proposed.

Document JP 1177327 describes readily machinable nickel silver alloys having good hot and cold forming properties. These alloys consist of 6 to 15% Ni, 3 to 8% Mn, 0.1 to 2.5% Pb, 31 to 47% Zn, remainder Cu with unavoidable impurities. Small amounts of Fe, Co, B, Si or P can optionally be added, in order to prevent the grain growth upon heating before the hot forming.

Document DE 10 2009 021 336 A1 discloses copper-nickel-zinc alloys which, on account of their special properties in respect of the ability to be cold formed, strength, machinability and corrosion resistance, are used for core tips of ballpoint pens. The alloys consist of 40 to 48% Cu, 8 to 14% Ni, 4 to 6.5% Mn, 0.05 to 1.5% Si, remainder Zn and unavoidable impurities. Optionally, up to 1.5% Al or up to 2.5% Pb can also be added. The wear resistance is ensured by a relatively large proportion of Ni—Mn mixed silicides incorporated in the microstructure.

The invention is based on the object of further developing nickel silver alloys with respect to their mechanical properties, their workability and their material costs. In particular, the intention is for the alloy to be comparable with ferritic CrMo steels in terms of strength and ductility and at the same time to be readily machinable and resistant to water-based writing gels.

The invention is represented in terms of a copper-nickel-zinc alloy, a production process and advantageous embodiments and developments of the invention.

The invention includes a copper-nickel-zinc alloy having the following composition in % by weight:

| | |
|---|---|
| Cu | 47.0 to 49.0%, |
| Ni | 8.0 to 10.0%, |
| Mn | 0.2 to 0.6%, |
| Si | 0.05 to 0.4%, |
| Pb | 1.0 to 1.5%, |
| Fe and/or Co up to 0.8%, | |

remainder Zn and unavoidable impurities, wherein the sum total of the Fe content and twice the Co content is at least 0.1% by weight, and wherein mixed silicides containing nickel, iron and manganese and/or mixed silicides containing nickel, cobalt and manganese are incorporated as spherical or ellipsoidal particles in a microstructure consisting of α and β phase.

The invention is based on the consideration here that the microstructure of nickel silver materials is varied by the addition of silicon to the alloy such that silicide precipitations are formed. Silicides as intermetallic compounds have a significantly higher hardness, at approximately 800 HV, than the α and β phase of the matrix microstructure. In principle, manganese is added to the alloy to improve the cold and hot forming properties and to increase the strength. Moreover, manganese has a deoxidizing and desulfurizing action. When manganese, iron and nickel are present at the same time, silicon forms mixed silicides with approximate compositions predominantly between $(Mn,Fe,Ni)_2Si$ and $(Mn,Fe,Ni)_3Si$. Similarly, when manganese, cobalt and nickel are present at the same time, silicon forms mixed silicides of the approximate compositions $(Mn,Co,Ni)_xSi_y$, where $x \geq y$. Furthermore, mixed silicides which contain both iron and cobalt in addition to manganese and nickel can also be formed. The mixed silicides are present in finely distributed form as spherical or ellipsoidal particles in the matrix microstructure. The diameter of the particles is generally smaller than 2 μm. The microstructure does not contain any silicides which have a large area and therefore readily break out of the matrix microstructure. In the case of the alloy according to the invention, this advantageous property is achieved in particular by the small proportions of manganese and iron or cobalt. Both iron and cobalt act as nucleation sites for the silicide formation, i.e. in the presence of iron and/or cobalt, even small deviations from the thermodynamic equilibrium suffice for the formation of small precipitations. These precipitation nuclei, which in the case of the present alloy composition can also contain nickel, are finely distributed in the microstructure. Further silicides, which now also contain manganese, preferably accumulate thereon. The size of the individual silicides is limited by the small manganese content of the alloy. Small quantities of iron and/or cobalt in combination with a small quantity of manganese are therefore the prerequisite for the formation of the mixed silicides which are essential to the invention. According to the invention, the minimum quantity of iron or cobalt is defined in that the sum total of the iron content and twice the cobalt content is at least 0.1%.

For cost-effective production, preference is given to nickel silver having a high element proportion of zinc and a comparatively low content of nickel and copper. These materials have a two-phase base microstructure consisting of a phase which can be readily cold formed and β phase which can be readily hot formed. Lead is distributed in extremely small droplets in the microstructure as a chip-breaking constituent of the microstructure. This makes the wrought alloy easier to machine, good hot forming properties of the two-phase alloy not being impaired considerably by lead.

The particular advantages of the nickel silver alloy according to the invention in terms of its mechanical properties and its workability can be stated in summary as follows:

- cost-effective nickel silver alloy owing to a high zinc proportion of approximately 40%;
- tensile strength of more than 750 MPa;
- cold forming capability of at least 40%;
- good machinability;
- possibility for near-net-shape shaping through hot forming.

In a preferred configuration of the invention, either the iron content or the cobalt content is at least 0.1% by weight. The content of the respectively other element can then be chosen freely between 0 and 0.8% by weight. The minimum content of one of the two elements ensures that precipitation nuclei are formed in a sufficient density even in the case of small deviations from the thermodynamic equilibrium.

In a further preferred configuration of the invention, the sum total of the iron content and eight times the cobalt content is at least 0.4% by weight. Cobalt preferably forms precipitation nuclei. This makes it possible to replace iron proportions with small quantities of cobalt. Depending on the precise demands made of the alloy, it is possible to set an optimum between properties and costs.

A preferred configuration of the invention includes a copper-nickel-zinc alloy having the following composition in % by weight:

| | |
|---|---|
| Cu | 47.0 to 49.0%, |
| Ni | 8.0 to 10.0%, |
| Mn | 0.2 to 0.6%, |
| Si | 0.05 to 0.4%, |
| Pb | 1.0 to 1.5%, |
| Fe | 0.2 to 0.8%, |

remainder Zn and unavoidable impurities, optionally up to 0.8% Co, wherein mixed silicides containing nickel, iron and manganese are incorporated as spherical or ellipsoidal particles in a microstructure consisting of α and β phase.

In the copper-nickel-zinc alloys, iron increases the strength and hardness. The preferred selection of the iron content brings about a suitable formation of iron-containing precipitation nuclei for the mixed silicides according to the invention, and therefore the latter are present in finely distributed form as spherical or ellipsoidal particles in the matrix microstructure. The diameter of the particles is generally smaller than 1 μm. Particular preference is given to an iron content of 0.4 to 0.6% by weight. The alloy can optionally be modified by the addition of small amounts of cobalt, with the favorable properties being retained, and in this way can be adapted to the operational requirements. Preference is given to a cobalt content of up to 0.8% by weight, and particular preference is given to a cobalt content of up to 0.6% by weight.

In a preferred configuration of the invention, the copper-nickel-zinc alloy can have the following composition in % by weight:

| | |
|---|---|
| Cu | 47.0 to 49.0%, |
| Ni | 9.0 to 9.8%, |
| Mn | 0.3 to 0.4%, |
| Si | 0.1 to 0.3%, |
| Pb | 1.0 to 1.5%, |
| Fe | 0.4 to 0.6%, |

remainder Zn and unavoidable impurities, optionally up to 0.6% Co.

The preferred selection of the iron content brings about a suitable formation of iron-containing precipitation nuclei for the mixed silicides according to the invention. A nickel proportion of 9.0 to 9.8% by weight provides a cost-effective and readily workable alloy. The proportions of silicon and manganese in terms of weight ultimately determine the extent and the topology of the silicide formation. In order to obtain particularly small silicides, the manganese proportion should not lie above 0.4% by weight. Overall, it is ultimately possible using the preferred manganese and silicon proportions to provide a material optimized in terms of the mechanical properties in combination with good workability.

In a preferred configuration of the invention, the ratio of the sum total of the proportions by weight of the elements Ni, Fe and Mn bound in silicides to the proportion by weight of the silicon bound in silicides can be between 3 and 6.5. In this respect, it is preferable that mixed silicides with approximate compositions between $(Mn,Fe,Ni)_2Si$ and $(Mn,Fe,Ni)_3Si$ are formed. Depending on the composition and the procedure during production and processing, it is also possible for mixed silicides which differ slightly in stoichiometry to be formed, it being possible for these to also contain, for example, small proportions of other alloy elements such as copper and zinc.

In a particularly preferred configuration of the invention, the ratio of the sum total of the proportions by weight of the elements Ni, Fe and Mn bound in silicides to the proportion by weight of the silicon bound in silicides can be between 4 and 6. Favorable properties of the alloy arise in this range of the concentration ratios.

In an advantageous embodiment of the invention, the ratio of the sum total of the proportions by weight of the elements Ni and Fe bound in silicides to the proportion by weight of the manganese bound in silicides can be at least 4. On account of the low manganese content, small mixed silicides form as spherical or ellipsoidal particles, which do not break out of the matrix microstructure. The diameter of the particles is generally smaller than 1 μm.

In a particularly advantageous embodiment of the invention, the areal density of the silicides having a particle diameter of at most 1 μm can be at least 20 per 100 $\mu m^2$. This ensures that a sufficient number of silicides are present in a favorable size.

A further aspect of the invention includes a copper-nickel-zinc alloy having the following composition in % by weight:

| | |
|---|---|
| Cu | 47.0 to 49.0%, |
| Ni | 8.0 to 10.0%, |

-continued

| | |
|---|---|
| Mn | 0.2 to 0.6%, |
| Si | 0.05 to 0.4%, |
| Pb | 1.0 to 1.5%, |
| Co | 0.1 to 0.8%, |

remainder Zn and unavoidable impurities, optionally up to 0.8% Fe, wherein mixed silicides containing nickel, cobalt and manganese are incorporated as spherical or ellipsoidal particles in a microstructure consisting of α and β phase.

The preferred selection of the cobalt content brings about a suitable formation of cobalt-containing precipitation nuclei for the mixed silicides according to the invention, and therefore the latter are present in finely distributed form as spherical or ellipsoidal particles in the matrix microstructure. The diameter of the particles is generally smaller than 2 μm. The alloy can optionally be modified by the addition of small amounts of iron, with the favorable properties being retained, and in this way can be adapted to the operational requirements. Preference is given to an iron content of up to 0.8% by weight, and particular preference is given to an iron content of up to 0.6% by weight.

In a preferred configuration of the invention, the copper-nickel-zinc alloy can have the following composition in % by weight:

| | |
|---|---|
| Cu | 47.0 to 49.0%, |
| Ni | 9.0 to 9.8%, |
| Mn | 0.3 to 0.4%, |
| Si | 0.1 to 0.3%, |
| Pb | 1.0 to 1.5%, |
| Co | 0.2 to 0.6%, |

remainder Zn and unavoidable impurities, optionally up to 0.6% Fe.

The preferred selection of the cobalt content brings about a suitable formation of cobalt-containing precipitation nuclei for the mixed silicides according to the invention. A nickel proportion of 9.0 to 9.8% by weight provides a cost-effective and readily workable alloy. The proportions of silicon and manganese in terms of weight ultimately determine the extent and the topology of the silicide formation. In order to obtain particularly fine-grained silicides, the manganese proportion should not lie above 0.4% by weight. Overall, it is ultimately possible using the preferred manganese and silicon proportions to provide a material optimized in terms of the mechanical properties in combination with good workability.

In a preferred configuration of the invention, the ratio of the sum total of the proportions by weight of the elements Ni, Co and Mn bound in silicides to the proportion by weight of the silicon bound in silicides can be between 2.5 and 5. In this respect, it is preferable that mixed silicides of the approximate compositions $(Mn,Co,Ni)_xSi_y$ are formed, where $x \geq y$ and $x < 2.5y$. Depending on the composition and the procedure during production and processing, it is also possible for mixed silicides which differ slightly in stoichiometry to be formed, it being possible for these to also contain, for example, small proportions of other alloy elements such as copper and zinc.

In a particularly preferred configuration of the invention, the ratio of the sum total of the proportions by weight of the elements Ni, Co and Mn bound in silicides to the proportion by weight of the silicon bound in silicides can be between 3 and 4.5. Favorable properties of the alloy arise in this range of the concentration ratios.

In an advantageous embodiment of the invention, the ratio of the sum total of the proportions by weight of the elements Ni and Co bound in silicides to the proportion by weight of the manganese bound in silicides can be at least 10. On account of the low manganese content, small mixed silicides form as spherical or ellipsoidal particles, which do not break out of the matrix microstructure. The diameter of the particles is generally smaller than 2 μm.

It is advantageous in the case of a copper-nickel-zinc alloy according to the invention that the ratio of the proportion by weight of the nickel bound in silicides to the proportion by weight of the cobalt bound in silicides can be between 1.5 and 2.5. The silicides formed in this way contribute to the advantageous properties of the alloy.

In a particularly advantageous embodiment of the invention, the areal density of the silicides having a particle diameter of at most 2 μm can be at least 20 per 5000 $\mu m^2$. This ensures that a sufficient number of silicides are present in a favorable size.

A further aspect of the invention relates to a process for producing wires, rods and profiles made of the copper-nickel-zinc alloy according to the invention. The invention includes a process in which the following steps are carried out:

a) producing bolts by means of diecasting or continuous casting, b) extrusion, c) a heat treatment at temperatures slightly below the melting temperature of the alloy, with subsequent quenching, d) cold forming with a degree of deformation of at least 25%, e) age annealing between 350° C. and 500° C.

The heat treatment in step c) can preferably be carried out at a temperature which is 85 to 95% of the melting temperature of the alloy, measured in ° C. The duration of the heat treatment can preferably be between one minute and three hours. The age annealing in step e) makes it possible to increase the strength of the material over the strength after the cold forming in step d). This procedure makes it possible to achieve an increase in the hardness of between 10% and 20%, depending on the annealing temperature.

A further aspect of the invention relates to an alternative process for producing wires made of the copper-nickel-zinc alloy according to the invention. The invention includes a process in which the following steps are carried out:

a) producing cast wire by means of wire casting, b) at least one cold forming of the wire, c) a heat treatment at temperatures slightly below the melting temperature of the alloy, with subsequent quenching, d) cold forming with a degree of deformation of at least 25%, e) age annealing between 350° C. and 500° C., such that the strength of the alloy is further increased.

Higher-quality core tips for ballpoint pens are produced not least for esthetic reasons from nickel silver. In this respect, they are manufactured from machinable nickel silver wire material as a wrought material. To produce ballpoint pen cores, wire portions having a length of approximately 15 to 20 mm are bored centrically through their entire length. A stepped contour is made in the tip, that a ball made of tungsten carbide is pressed in and is fixed by final crimping such that it can rotate without play but does not come loose from the core tip. For this purpose, the nickel silver alloy has to have a cold forming capability of at least 40%, in order to make it possible to achieve crack-free crimping of the tip around the ball. The ink consumption of a ballpoint pen is determined by the wear to the ball seat caused by the ball made of tungsten carbide. The material should accordingly also be corrosion-resistant with respect to inks. Both the required cold forming capability and the corrosion resistance are ensured by the nickel silver alloy according to the invention.

Exemplary embodiments of the invention will be explained in more detail hereinbelow.

For the investigations, three alloy compositions CA, CC and CD of an α-β nickel silver were cast in a Tammann furnace to form blocks measuring approximately 25 mm×60 mm×100 mm (see Table 1).

TABLE 1

Chemical composition in % by weight

| | Cu | Zn | Ni | Mn | Si | Pb | Fe | Co |
|---|---|---|---|---|---|---|---|---|
| CA | 48.6 | 40.5 | 9.3 | 0.4 | | 1.2 | | |
| CC | 48.8 | 39.8 | 9.2 | 0.35 | 0.15 | 1.2 | 0.5 | |
| CD | 48.6 | 39.9 | 9.3 | 0.35 | 0.15 | 1.2 | | 0.5 |

The cast blanks were then reduced by 45% in a plurality of rolling passes at 750° C. Metal sheets having a thickness of 6 mm which were prepared therefrom by milling on both sides were subjected to cold rolling to 4 mm, and then to soft annealing at 650° C. for three hours. Then, these metal sheets were subjected to cold rolling to 2.88 mm, then to renewed annealing at 650° C. for three hours and to cold rolling to an end thickness of 2.0 mm. Finally, the strips were subjected to stress-relief annealing at 300° C.

Table 2 shows the mechanical properties achieved after the annealing at 300° C.:

TABLE 2

Mechanical properties of the alloys

| | HV10 | Rp0.2/MPa | Rm/MPa | A5/% |
|---|---|---|---|---|
| CA | 202 | 582 | 658 | 23 |
| CC | 242 | 712 | 769 | 6 |
| CD | 247 | 752 | 788 | 10 |

The silicon-containing variants CC and CD are harder and achieve higher strength values than the comparative material CA. Accordingly, micrographs illustrating the microstructure of the alloys CC and CD show a much finer-grained microstructure than the micrographs illustrating the microstructure of the silicon-free alloy CA. The gain in mechanical strength is explained by the formation of fine silicides: in a scanning electron microscope, small spherical and ellipsoidal precipitations are identifiable in the alloys CC and CD.

The local element composition of the α phase, the β phase and the silicides was determined for the variants CC and CD by means of energy dispersive X-ray analysis in a scanning electron microscope.

For the variant CC, the approximate weight ratios Cu:Zn=1.3:1 and Cu:Ni=5:1 are obtained for the α phase. In the β phase, the weight ratios are approximately Cu:Zn=0.9:1 and Cu:Ni=3:1 to 4:1. For the silicides, the energy dispersive X-ray analysis supplies a composition of the elements Cu, Zn, Ni, Mn, Si and Fe each in significant proportions. Beyond the silicides, proportions of less than 0.4% by weight are obtained for the elements Mn, Si and Fe. On account of the small size of the silicides, the high proportions of Cu and Zn in the X-ray signal for the silicides come from the environment in which the silicide is embedded. They effectively represent the background signal of the matrix. The signals for Cu and Zn in this respect are present very precisely in the ratio obtained for the pure α phase or the pure β phase. The X-ray signal for the element Ni is composed of the signal of the nickel bound in the silicide and the background signal of the nickel in the Cu—Ni—Zn matrix. The contribution of the nickel background signal can be determined from the local Cu content with the aid of the information relating to the phase (α or β) and the Cu:Ni ratio corresponding to the phase and can be subtracted from the total Ni signal. The nickel content of the silicide determined in this way can then be related with the elements Mn, Fe and Si. If the background signal represents a contribution of more than 50% of the total nickel signal, the declaration made in relation to the nickel content in the silicide is fraught with uncertainty. Using this method, values of between 4 and 5.7 were ascertained for the weight ratio (Ni+Fe+Mn)/Si in the silicide. The weight ratio (Ni+Fe)/Mn always assumes values of greater than 4.

The number of silicides per unit of area was determined with reference to the scanning electron microscope images. For the variant CC, at least 20 particles having a diameter of smaller than 1 μm were ascertained over 100 $\mu m^2$.

For the variant CD, too, the approximate weight ratios Cu:Zn=1.3:1 and Cu:Ni=5:1 are obtained for the α phase from the energy dispersive X-ray analysis. In the β phase, the weight ratios are approximately Cu:Zn=0.9:1 and Cu:Ni=3:1 to 4:1. For the silicides, the X-ray analysis supplies a composition of the elements Cu, Zn, Ni, Mn, Si and Co each in significant proportions. Beyond the silicides, proportions of less than 0.4% by weight are obtained for the elements Mn, Si and Co. As in the case of variant CC, the X-ray signal for the silicides contains high proportions of Cu and Zn. On account of the small size of the silicides, these proportions are interpreted as a background signal of the matrix in which the silicide is embedded. The signals for Cu and Zn in this respect are present very precisely in the ratio obtained for the pure α phase or the pure β phase. As described in the case of variant CC, the X-ray signal for the element Ni was adjusted by the contribution of the background signal of the nickel in the Cu—Ni—Zn matrix, and the nickel content of the silicide determined in this way was then related with the elements Mn, Co and Si. Using this method, values of between 2.5 and 4.5 were ascertained for the weight ratio (Ni+Co+Mn)/Si in the silicide. The weight ratio (Ni+Co)/Mn always assumes values of greater than 10. Furthermore, the ratio of the nickel bound in silicides to the cobalt bound in silicides always assumes values of between 1.5 and 2.5.

The number of silicides per unit of area was determined with reference to the scanning electron microscope images. For the variant CD, at least 20 particles having a diameter of smaller than 2 μm were ascertained over 5000 $\mu m^2$.

In order to reconstruct wire production, the pure metals copper, zinc, nickel and lead were melted together with a corresponding quantity of binary prealloys of copper and iron, copper and silicon and copper and manganese in a medium-frequency furnace and cast in stationary steel molds with a diameter of 220 mm. In preparation for the extrusion of wires, the oxidized surfaces of the solidified cylindrical cast blocks were removed by cutting. With the aid of an extruder, cast blocks having a length of 500 mm were pressed to form wires having a diameter of 4 mm. The chemical composition of a pressed wire was analyzed in a wet chemical process by ICP-OES (figures in % by weight):

| | Cu | Zn | Ni | Mn | Si | Pb | Fe | Co |
|---|---|---|---|---|---|---|---|---|
| Pressed wire | 48.4 | 39.6 | 9.5 | 0.36 | 0.32 | 1.3 | 0.49 | 0.01 |

The melting point of the alloy is approximately 850° C. After the extrusion, the wire was subjected to a heat treatment at 800° C. and then quenched. Forming with a degree of deformation of 28% was effected by cold rolling the wire to a wire thickness of 3 mm. After the cold forming, the hardness was 175 HV 10. Age annealing for three hours at temperatures of between 350° C. and 500° C. hardened the material, this being expressed in hardness values of up to 207 HV 10. This increase in the strength is explained by the formation of silicides of the elements still in solution during the age annealing.

What is claimed is:

1. A copper-nickel-zinc alloy having the following composition, in % by weight:

| | |
|---|---|
| Cu | 47.0 to 49.0%, |
| Ni | 8.0 to 10.0%, |
| Mn | 0.2 to 0.6%, |
| Si | 0.05 to 0.4%, |
| Pb | 1.0 to 1.5%, |
| Co | 0.1 to 0.8%, |

remainder Zn and unavoidable impurities,
optionally up to 0.8% Fe,
wherein mixed silicides containing nickel, cobalt and manganese are incorporated as spherical or ellipsoidal particles in a microstructure consisting of α and β phase and an areal density of the silicides having a particle diameter of at most 2 μm is at least 20 per 5000 $\mu m^2$.

2. The copper-nickel-zinc alloy as claimed in claim 1 having the following composition, in % by weight:

| | |
|---|---|
| Cu | 47.0 to 49.0%, |
| Ni | 9.0 to 9.8%, |
| Mn | 0.3 to 0.4%, |
| Si | 0.1 to 0.3%, |
| Pb | 1.0 to 1.5%, |
| Co | 0.2 to 0.6%, |

remainder Zn and unavoidable impurities,
optionally up to 0.6% Fe,
wherein mixed silicides containing nickel, cobalt and manganese are incorporated as spherical or ellipsoidal particles in a microstructure consisting of α and β phase.

3. The copper-nickel-zinc alloy as claimed in claim 1, characterized in that a ratio of a sum total of proportions by weight of the elements Ni, Co and Mn bound in silicides to the proportion by weight of the silicon bound in silicides is between 2.5 and 5.

4. The copper-nickel-zinc alloy as claimed in claim 3, characterized in that the ratio of the sum total of the proportions by weight of the elements Ni, Co and Mn bound in silicides to the proportion by weight of the silicon bound in silicides is between 3 and 4.5.

5. The copper-nickel-zinc alloy as claimed in claim 1, characterized in that a ratio of a sum total of proportions by weight of the elements Ni and Co bound in silicides to proportion by weight of the manganese bound in silicides is at least 10.

6. The copper-nickel-zinc alloy as claimed in claim 1, characterized in that a ratio of proportion by weight of the nickel bound in silicides to proportion by weight of the cobalt bound in silicides is between 1.5 and 2.5.

* * * * *